United States Patent [19]

Dei et al.

[11] Patent Number: 4,750,731

[45] Date of Patent: Jun. 14, 1988

[54] SHEET STORING APPARTUS

[75] Inventors: Katsuhito Dei, Kawasaki; Junichi Kimizuka, Yokohama; Masaaki Ishii, Zama, all of Japan

[73] Assignee: Canon Kabushiki Kaisha, Tokyo, Japan

[21] Appl. No.: 744,644

[22] Filed: Jun. 13, 1985

Related U.S. Application Data

[63] Continuation of Ser. No. 405,863, Aug. 6, 1982, abandoned.

[30] Foreign Application Priority Data

Aug. 14, 1981 [JP] Japan ..... 56-126651
Aug. 14, 1981 [JP] Japan ..... 56-126652

[51] Int. Cl.[4] ..... B65H 39/10

[52] U.S. Cl. ..... 271/287; 271/289; 271/290; 355/14 SH; 209/564

[58] Field of Search ..... 271/290, 297, 288, 289, 271/287, 296, 298, 305, 279; 270/58; 355/14 SH; 209/564; 364/478, 479

[56] References Cited

U.S. PATENT DOCUMENTS

| | | | |
|---|---|---|---|
| 3,618,936 | 11/1971 | Ziehm | 271/290 |
| 4,012,032 | 3/1977 | Rogers | 271/290 |
| 4,124,121 | 11/1978 | Sung et al. | 271/305 |
| 4,190,246 | 2/1980 | Sasuga | 355/14 SH |
| 4,265,446 | 5/1981 | McMillan et al. | 271/279 |
| 4,432,458 | 2/1984 | Daboub | 209/564 |

*Primary Examiner*—Joseph J. Rolla
*Attorney, Agent, or Firm*—Fitzpatrick, Cella, Harper & Scinto

[57] ABSTRACT

In a serial connection of plural sheet sorters, each sorter is capable of checking the state of downstream sorters and, in case an assigned sorter is not in a normal state, the sheets are stored in an immediately preceding sorter. In this manner it is made possible to prevent a situation where the function of the entire sorters is blocked by a single failure. Also sorters of desired number can be connected in series since same control circuits can be used in all sorters.

6 Claims, 5 Drawing Sheets

LBP
CH1
CH2
CH3
CH4
1a
1b
1c
2c
3c
4c
4e
5a
5b-1
5b-2
5b-3
5b-n
5c
5e
5f-1
5f-n
5-1
5-2
5-3
5-n
6a
6b-1
6b-2
6b-3
6b-n
6c
6e
6f-1
6f-n
6-1
6-2
6-n
7a
7b-1
7b-2
7b-3
7b-n
7c
7e
7f-1
7f-n
7-1
7-2
7-3
8-1
8-2
8-3
11
12
13
14

CH1
CH2
CH3
CH4
1d
5d
6d
7d
11
12
13
14
15
16
17
18
19
20

SHEET STORING APPARTUS

This application is a continuation of application Ser. No. 405,863 filed Aug. 6, 1982, now abandoned.

BACKGROUND OF THE INVENTION

1. Field of the Invention

The present invention relates to a sheet storing apparatus, and more particularly to a sheet storing apparatus capable of storing the sheets from an image recording apparatus or the like into determined storage stages according to command instructions.

2. Description of the Prior Art

A conventional sheet storing apparatus attached, for example, to an image recording apparatus is provided with plural storage stages or bins and is adapted to store corresponding sheets sequentially into said storage stages with succeeding sheets stored again from the first storage stage.

However, in case it is desired to store a sheet from the image recording apparatus into an arbitrarily selected stage, the image recording apparatus has to be provided with a function of processing data concerning the stage for storing the sheet, simultaneously with the ejection of the sheet. Particularly in case plural units of sheet storing apparatus are connected to an image recording apparatus, said apparatus has to be capable of processing the instructions from the image recording apparatus and the responses from the sheet storing apparatus, so that the involved data processing is inevitably complicated and imposes a significant burden to the image recording apparatus.

SUMMARY OF THE INVENTION

In consideration of the foregoing, an object of the present invention is to provide a sheet storing apparatus allowing storage of the sheets ejected from an image recording apparatus into arbitrary storage stages without complicated data processing and at the same time alleviating the burden of the image recording apparatus.

Another object of the present invention is to provide a sheet storing apparatus capable of checking the state not only of one unit but also of succeeding downstream units, thereby enabling serial connection of an arbitrary number of plural units.

Still another object of the present invention is to provide a sheet storing apparatus capable of preventing a situation where the function of plural units of sheet storing apparatus is blocked by a single failure therein.

BRIEF DESCRIPTION OF THE DRAWINGS

The attached drawings illustrate an embodiment of the present invention, wherein.

DESCRIPTION OF THE PREFERRED EMBODIMENTS

Figure 1:
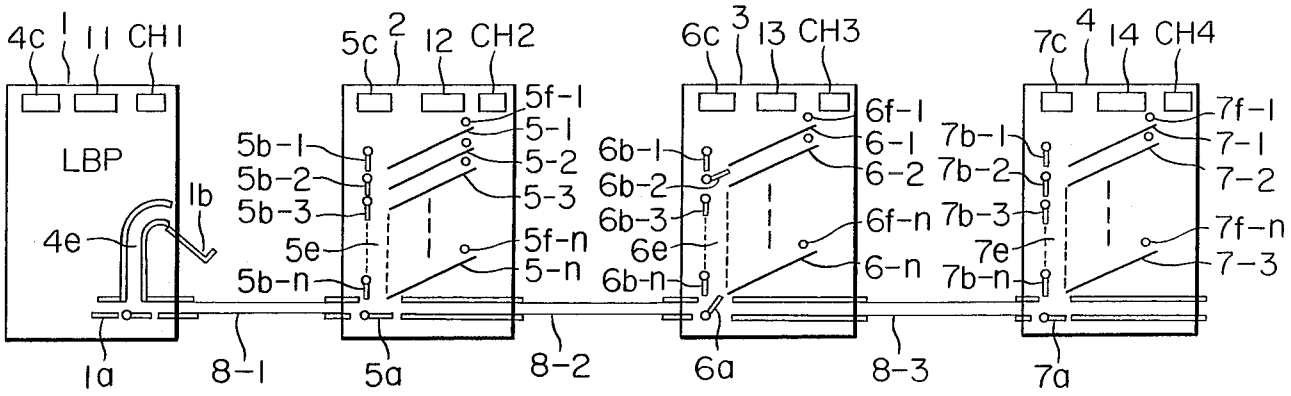
FIG. 1 is a schematic view of sorters connected to a laser beam printer.

FIG. 1 shows an embodiment of the present invention wherein an image recording apparatus 1, such as a laser beam printer (LBP), is connected to three similar sheet storing apparatus 2–4, such as sorters.

Each of the sheet storing apparatus 2–4 is provided with plural storage stages or bins 5-1, 5-2, . . . , 7-1, 7-2, . . . , 7-n, and sheet transport paths 8-1, 8-2, 8-3 are provided between the image recording apparatus 1 and the sheet storing apparatus 2 and between the different units of said sheet storing apparatus. Said sheet transport paths 8 may however be dispensed with in case said image recording apparatus and said plural sheet storing apparatus are directly connected.

The recording sheets ejected from the image recording apparatus 1 are supplied, through said transport paths 8, to the storage stages 5–7 of the sheet storing apparatus 2–4.

The laser beam printer 1 and the sheet storing apparatus 2–4 are respectively provided with transport path selectors 1*a*, 5*a*–7*a* for selecting whether to store the transported sheets in one unit or to deliver the sheets to a succeeding unit. The sheets merely pass the image recording apparatus or the sheet storing apparatus in case the selector is in a state as illustrated by 1*a*, 5*a* or 7*a*, but a selector in a state as illustrated by 6*a* guides the sheets into the corresponding unit. Each of the sheet storing apparatus 2–4 is provided with a transport path 5*e*–7*e* passing through a side of the storage stages while the image recording apparatus 1 is provided with a transport path 4e, and the sheets guided into said transport paths 5*e*–7*e* are directed to desired storage stages by bin selectors 5*b*–7*b* actuated by bin selecting signals. The image recording apparatus is however provided with only one storage bin 1*b*. More specifically, the sheet in one of said transport paths 5*e*–7*e* is guided upwards by an unrepresented conveyor belt, and is guided for example into a storage bin 6-2 by a bin selector in a state illustrated for example by 6*b*-2. The bin selectors in the other state do not interfere with the transportation of the sheet in said path.

Each of the storage stages or bins of the sheet storing apparatus 2–4 is provided with a full-stage sensor 5*f*–7*f* for indicating that a determined amount of sheets is stored in said stage.

Also the image recording apparatus 1 and the sheet storing apparatus 2–4 are provided with input switches 4*c*, 5*c*–7*c* for entering respective identification numbers, a control device 11 for controlling the image recording apparatus 1, control devices 12–14 having microcomputers for controlling the respective storing apparatus and monitoring the downstream storing apparatus with respect to the transport direction of the recording sheets, and connector check switches CH1–CH4 for sensing whether signal lines for exchanging electric signals with the succeeding unit are properly connected.

Figure 2A:
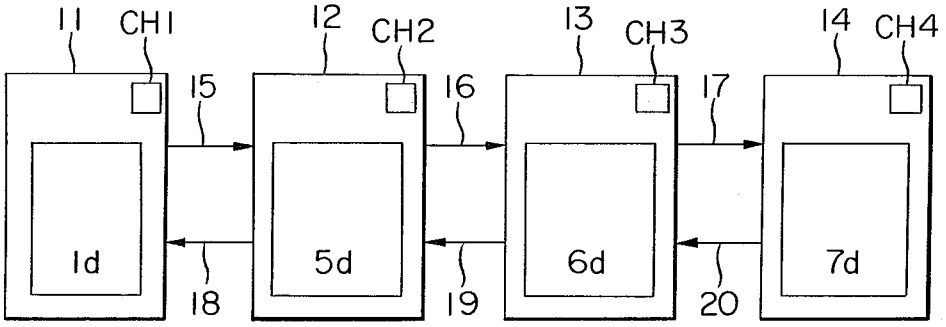
FIG. 2A is a block diagram showing electric connections in FIG. 1.

FIG. 2A is a block diagram showing the flow of electric signal among the control devices 11–14 with microcomputers provided in the image recording apparatus 1 and sheet storing apparatus 2–4, wherein signal lines 15–17 are utilized for transmitting information on the storing apparatus and storage bin for storing the sheet ejected from the image recording apparatus 1 among the control devices in the order from 11 to 12, then 13 to 14, while signal lines 18–20 are utilized for transmitting information on the status of the sheet storing apparatus and storage stages among the control devices in the order from 14 to 13, then 12 to 11. The aforementioned check switch CH1 releases a signal "0" or "1" respectively when the signal lines 15, 18 are properly connected between the units 1 and 2 or not, and other switches function similarly.

Figure 2B:
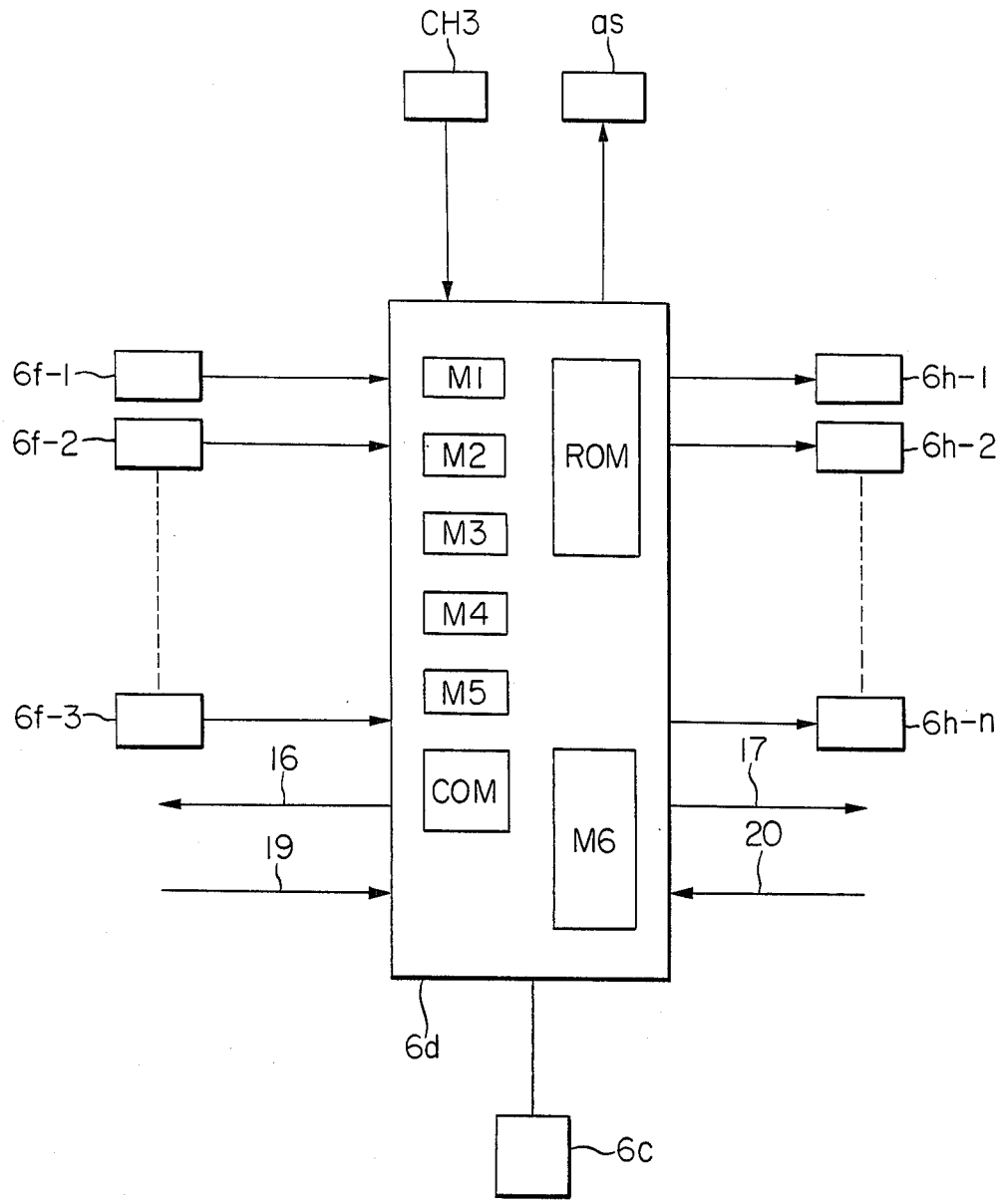
FIG. 2B is a block diagram showing input and output signals of a microcomputer provided in the sorter.

FIG. 2B shows the microprocessor (CPU) in the control device 13 and the input and output signal to and from said control device, and the control devices 11, 12 and 14 have the same structure. Also the control device 11 in the recording apparatus 1 has substantially the same structure and programs. In FIG. 2B, the microcomputer (CPU) **6*d* comprises memory areas M1–M6 for storing data, a comparator COM for data comparison, a read-only memory ROM for storing control programs as shown in FIGS. 3–6**, and other components contained in the ordinary microcomputers.

The microcomputer receives the output signals from the full-bin sensors **6*f*-1, . . . 6*f*-n, input switch 6*c* and connector check switch CH3, and releases output signals to solenoids 6*h*-1, . . . 6*h*-n for controlling the aforementioned selectors 6*a*, 6*b*-1, 6*b*-2, . . . , 6*b*-n and to a solenoid for controlling the selector 6*a***.

The signal lines 16, 19 are utilized for exchanging signals with the preceding unit 2, and the signal lines 17, 20 are utilized for exchanging signals with the succeeding unit 4.

The control devices 12, 14 have the same structure as shown in FIG. 2B, and the control device 11 also has a similar structure in addition to a function for controlling the recording apparatus itself. The image recording apparatus 1 does not have the solenoids **6*h*-1, . . . , 6*h*-n and sensors 6-1, . . . , 6-n since it is provided with only one storage stage, but still has the programs as shown in FIGS. 3 to 6**.

FIGS. 3 to 6 are flow charts for explaining the function of the control device of the structure described above.

At the start of the function of the device, steps starting from the Step 21 are executed for the initial set-up of the control device. In the present embodiment, a step represented with a rounded frame indicates that a certain control procedure is initiated from said step. The succeeding Step 22 performs the initial function of the device, for example resetting of the memories M1–M6. The Step 23 sets the identification number of the unit selected by the input switch **6*c*; for example "1" for the recording apparatus 1 and "2", "3" and "4" respectively for the storing apparatus 2, 3 and 4, in the memory area M1**. The foregoing procedure constitutes the STEP I.

Subsequently each control device self-checks the state of each storing apparatus in the Step 24, for example whether the sensors 6-1, . . . , 6-n are not broken, whether the solenoids **6*h*-1, . . . , 6*h*-n** and as are not in failure, whether the main motor and power supply are in normal state.

If the normal state is confirmed, the Step 27 is executed to set a signal "0" indicating the normal state in the status-1 memory M2. Also if an abnormality is found, the Step 25 is executed to generate an abnormal signal, which is set in said status-1 memory M2 in the Step 26. In such abnormal case, the function of the device is terminated by the STEP VII to be explained later, whereby the program execution is interrupted. Upon setting of the normal signal "0" in the status-1 memory in the Step 27, the program completes the STEP II and proceeds to the succeeding steps.

The succeeding Step 28 identifies the presence or absence of a succeeding device by the presence or absence of the output signal from the connector check switch CH, and, in the presence of such succeeding unit, the Step 29 is executed for sensing the content of the status-1 memory of said succeeding unit. Upon detection of a signal "0" indicating a normal state from said status-1 memory, a signal "00" indicating a normal state is stored in the status-2 memory M3, and the Step 30 is executed to set, in the memory M4, a signal indicating that the local unit is ready for function.

On the other hand, in case the absence of the succeeding unit is identified in the Step 28, the Step 31 is executed for generating a signal "01" indicating the last unit, which s set in the Step 32 in the status-2 memory, subsequently the program proceeds to the Step 30 for setting said ready signal. Also in case the Step 29 identifies an abnormal state in the status-1 memory of the succeeding unit, the Step 33 is executed to generate an abnormal signal "11" which is set in the Step 32 in the status-2 memory. The above-described procedure constitutes the Step III, and the program proceeds further after read-signal setting in the Step 30.

After the above-described pre-processing and in response to storage location data, for example signal 03-02 instructing a second storage bin 6-2 of the storing apparatus 3, from an unrepresented magnetic tape device, the Step 35 is executed to temporarily store said data in the memory M6 and to compare said data in the comparator C with the data of the local unit, in order to identify that said instruction is directed to the local unit in case of coincidence, or that said instruction is directed elsewhere in case of absence of coincidence. The foregoing procedure constitutes the STEP IV.

In the illustrated example where the sheet storing apparatus 3 is designated, the control device 11 identifies that the instruction is not directed to itself by comparison of the own identification number "1" with the instruction signal "3", whereby the program jumps to the Step 37 for identifying if the content of the status-2 memory is "00". If said content is "00" indicating that the succeeding unit is in normal state, the program proceeds to the STEP VIII shown in FIG. 6 for transmitting the information to the succeeding control device 12, which stores, in the Step 35, the transmitted information in the memory M6 of the microcomputer thereof.

In case the Step 37 identifies that the content of the status-2 memory is "11" indicating that the succeeding unit is not in normal state, the Step 38 is executed to store the sheet in a sample tray of the local unit, for example the first bin 5-1. This procedure is summarized as the STEP IV.

The sheet storing apparatus 2 performs the same processing as explained in relation to the control device 11, and the control device 12 transmits the storage location data in the STEP VIII to the control device 13 of the sheet storing apparatus 3.

The control device 13 identifies in the STEP IV that the local storing apparatus 3 is designated and proceeds to the STEP V, wherein the Step 39 is executed to identify if the content of the status-3 memory M5 is "1" indicating that the designated storage bin is already full, and, if said content is "0" indicating that said designated storage bin still has a room, the Step 40 is executed to activate the selector **6*b*-2 for storing the sheet into the designated storage bin. Thereafter the program returns to the main routine 34**.

In case the sensor **6*f*-2 releases a signal "1" indicating that the designated storage bin is full, the sheet storage is conducted after setting said signal "1" in the status-3 memory in the Step 41**. Thereafter the program returns to the STEP IV for awaiting the succeeding sheet and the corresponding storage location data.

In the foregoing embodiment, each storage bin of each sheet storing apparatus is so structured that it can store at least a sheet after the corresponding full-bin sensor releases the full-bin signal. Also each of the apparatus 1–4 is either provided with an additional sample tray besides the aforementioned storage bins, or uses one of the storage bins as the sample tray, for example the uppermost bin 5-1, 6-1 or 7-1, or the tray 1*b* of the recording apparatus 1.

Figure 3:
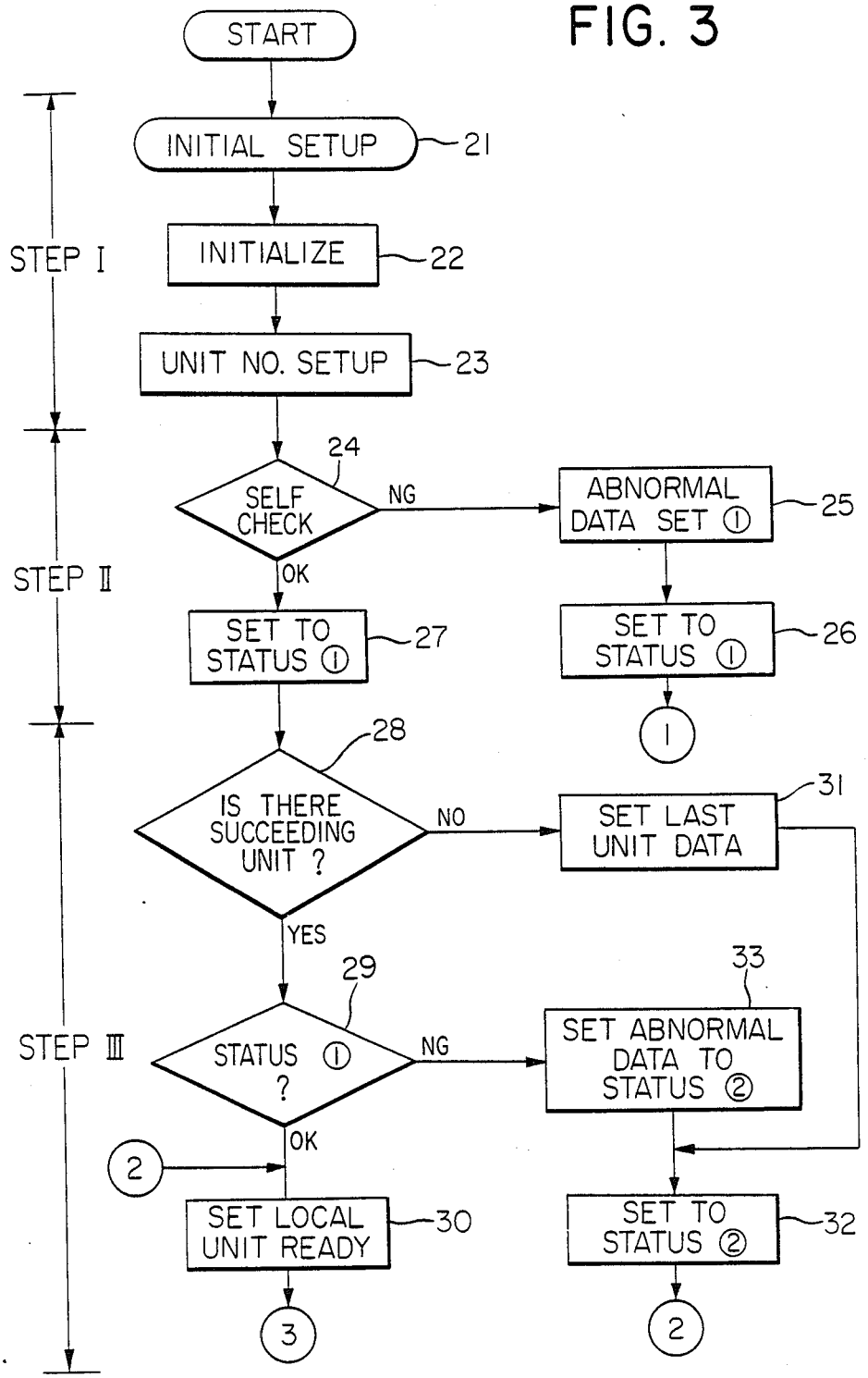
FIGS. 3 to 6 are flow charts showing the control sequence of the microcomputer shown in FIG. 2B.
Figure 4:
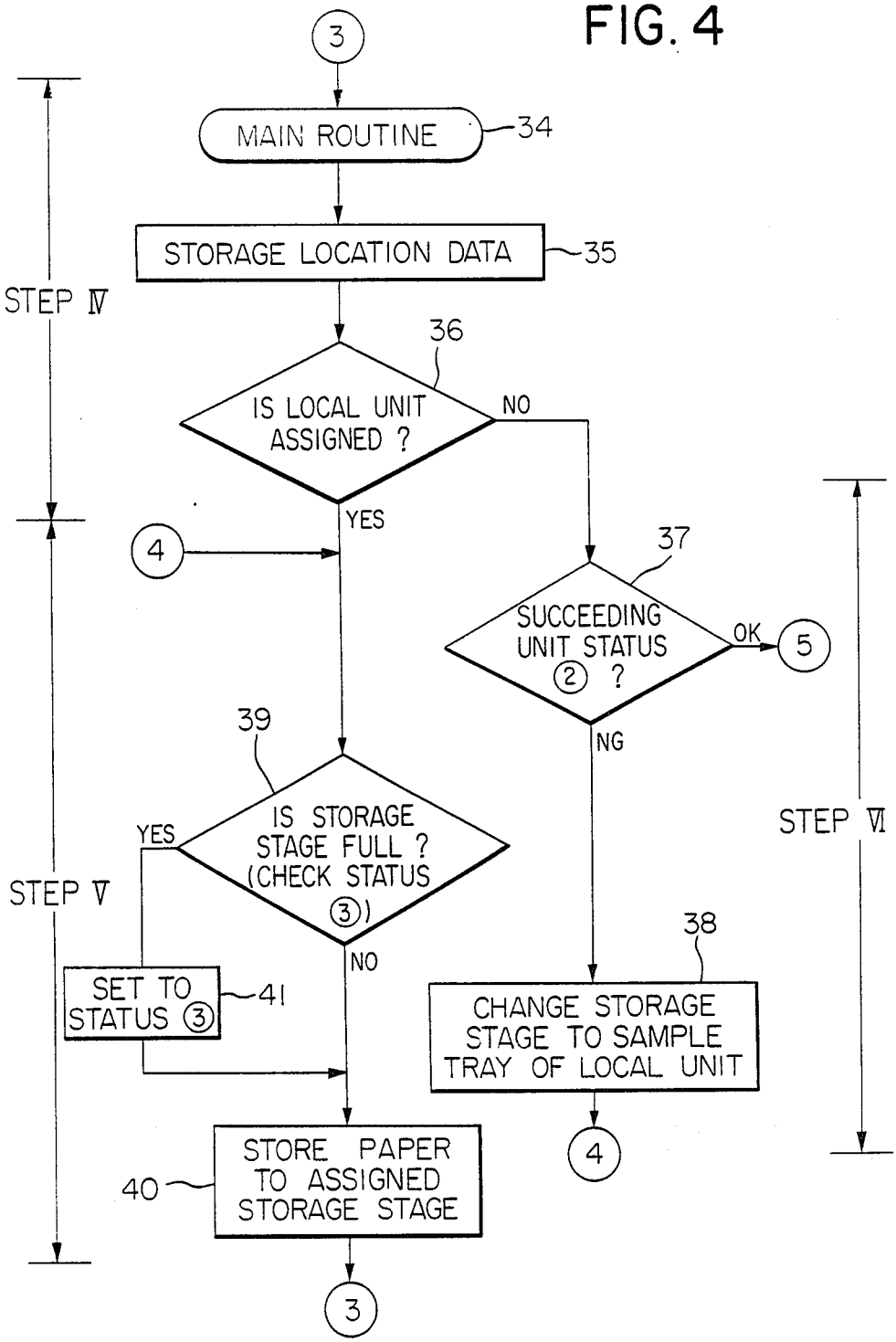
Figure 5:
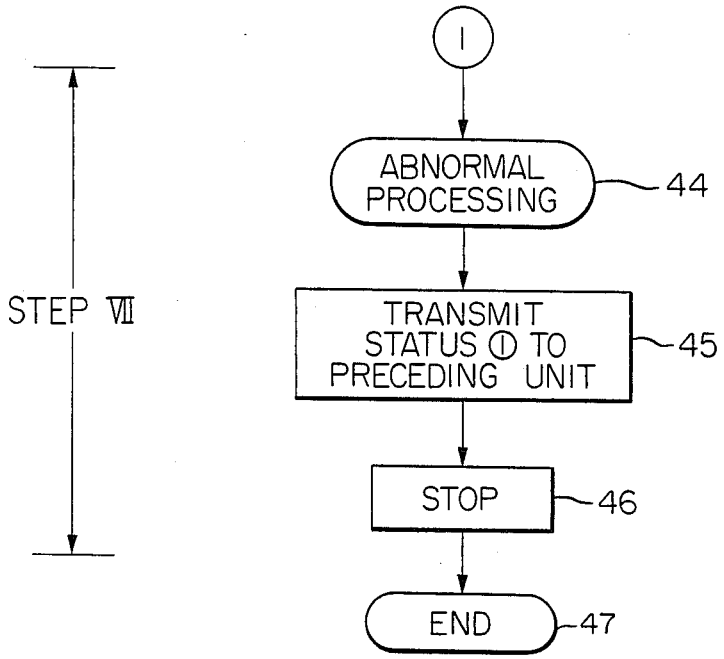
Figure 6:
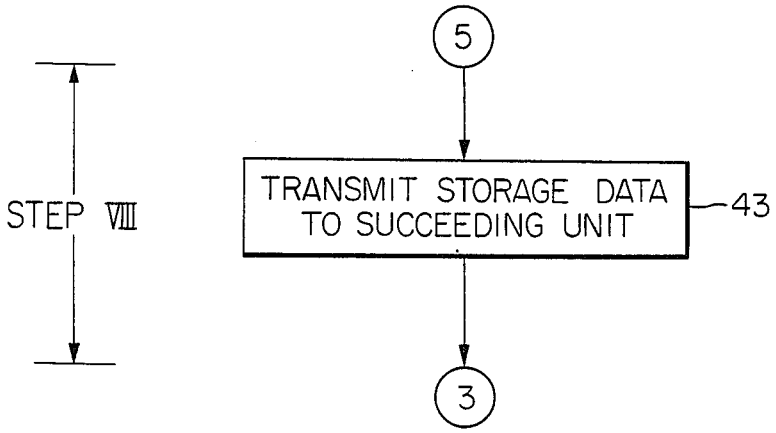

FIG. 5 shows an abnormal process floor subsequent to the Step 25 shown in FIG. 3. When the abnormal signal generated in the Step 25 is set in the Step 26 in the status-1 memory, the abnormal process routine is initiated from the Step 44, whereby the Step 45 is executed to transmit the abnormal signal of the status-1 memory to the preceding unit. Then the Step 46 terminates the function of the apparatus, and the Step 47 terminates the program execution. The foregoing procedure constitutes the STEP VII.

The above-described control flows allow delivery of the sheet to a selected one of plural sheet storing apparatus through an extremely simple signal processing, to reduce the burden of the control device belonging to the image recording apparatus, and to employ the same control devices for all the units.

Although the number of sheet storing apparatus has been selected as two in the foregoing description, it is naturally possible to use two, four or more units.

Also the data concerning the storing apparatus and the storage bin for storing the sheet in the foregoing embodiment is received by the image recording apparatus 1 from the exterior, but such data may also be generated in said apparatus 1.

Also in case the sheet storing apparatus are absent, the STEP II and the STEP VII of the control device 11 may be utilized for storing the sheets in a storage location 1*b* provided in the image recording apparatus. Naturally, in such case, such storage location has to be provided in the image recording apparatus.

Furthermore, the status-1 memory and the status-2 memory of each sheet storing apparatus are monitored, in the preceding embodiment, by the control device of the immediately preceding unit, but such monitoring may be performed by the control device of a further upstream unit by transmitting the corresponding signal to said unit.

What we claim is:

1. A sheet storing apparatus comprising:

recording means for recording information on recording sheets;

plural storage means each having plural storage bins for storing recording sheets ejected from said recording means, wherein each of said storage means comprises first memory means for storing status information of the associated storage means, and control means comprising second memory means for reading and storing the content of said first memory means of the downstream storage means;

transfer means for transferring said recording sheets from said recording means to one of said storage means and from one of said storage means to another storage means; and transmission means for transmitting the status information stored in said first memory means with respect to a transfer direction of said recording sheets from the control means of the downstream storage means to the control means of the upstream storage means.

2. A sheet storing apparatus comprising:

recording means for recording information on recording sheets;

plural storage means each having plural storage bins for storing the recording sheets ejected from said recording means, wherein each of said storage means comprises first memory means for storing if respective storage means function in a normal manner;

passage means for forming passages for said recording sheets among said recording means and said plural storage means; and control means for causing the recording sheets to be stored in a designated storage means, and if the designated storage means does not function in a normal manner, to be stored in a predetermined storage means, wherein said predetermined storage means is changeable in accordance with the connecting position of the storage means which does not function in a normal manner and said control means comprises second memory means adapted for reading and storing the content of said first memory means of a downstream storage means.

3. A sheet storing apparatus according to claim 2, wherein said control means comprises discriminator means for discriminating the content of said second memory means.

4. A sheet storing apparatus according to claim 2, wherein said control means is adapted to store the recording sheets in a determined storage bin of an upstream storage means.

5. A sheet storing apparatus comprising:

plural storage means each having plural storage bins for storing recording sheets, said plural storage means being arranged on a cascade connection basis;

passage means for forming passages for the recording sheets from the upstream storage means to the downstream storage mans with respect to a transfer direction of the recording sheets; and discriminating means provided in each of said storage means for identifying the connecting condition of another storage means downstream with respect to the transfer direction of the recording sheets, said discrimination means comprising memory means for storing discrimination results and means for transmitting and receiving data signals;

wherein said discriminating means transmits a predetermined data signal to the downstream storage means, and discriminates the connecting condition in accordance with a response data signal from said downstream storage means.

6. A sheet storing apparatus comprising:

plural storage means each having plural storage bins for storing recording sheets;

a microcontroller associated with each storage means for performing storage control of the recording sheets into said plural storage bins; and data transmission means for performing receiving and transmitting operations of data involved in the storage control for the recording sheets between the microcontrollers associated with said plural storage means;

wherein said microcontroller is adapted to determine whether or not the data transmitted form the microcontroller associated with the downstream storage means indicates that the downstream storage means is abnormal, and if abnormal, then to inhibit transmission of data involved in the storage control for the recording sheets to the microcontroller associated with the downstream storage means.

* * * * *

UNITED STATES PATENT AND TRADEMARK OFFICE

CERTIFICATE OF CORRECTION

PATENT NO. : 4,750,731

DATED : June 14, 1988

INVENTOR(S) : KATSUHITO DEI, ET AL.

It is certified that error appears in the above-identified patent and that said Letters Patent is hereby corrected as shown below:

Column 2, line 56, "signal" should read --signals--.

Column 4, line 25, "C" should read --COM--.

Column 5, line 12, "floor" should read --flow--.

Column 6, line 38, "mans" should read --means--.

Signed and Sealed this

Fourth Day of October, 1988

*Attest:*

*Attesting Officer*

DONALD J. QUIGG

*Commissioner of Patents and Trademarks*